United States Patent [19]

Woods, Jr. et al.

[11] 4,306,616

[45] Dec. 22, 1981

[54] REFRIGERATED SHELF FOR A FOOD DISPLAY COUNTER

[75] Inventors: John J. Woods, Jr., Florissant; Robert L. Bergholtz, St. Louis, both of Mo.

[73] Assignee: Duke Manufacturing Co., St. Louis, Mo.

[21] Appl. No.: 118,559

[22] Filed: Feb. 4, 1980

[51] Int. Cl.[3] ..... F28F 13/14; F28F 3/12

[52] U.S. Cl. ..... 165/136; 62/253; 62/444; 62/451; 62/458; 165/170

[58] Field of Search ..... 165/136, 185, 168–170; 62/520–522, 443, 444, 248, 253, 458, 451

[56] References Cited

U.S. PATENT DOCUMENTS

| | | | |
|---|---|---|---|
| 1,800,150 | 4/1931 | Musgrave et al. | 165/136 |
| 2,084,883 | 6/1937 | Atchison | 62/458 |
| 2,124,110 | 7/1938 | Hall | 62/451 |
| 2,276,811 | 3/1942 | Ward | 62/444 |
| 2,625,378 | 1/1953 | Nason | 165/136 |
| 2,637,530 | 5/1953 | Janos | 165/136 |
| 2,759,339 | 8/1956 | Kundert | 62/458 |
| 2,856,163 | 10/1958 | Bidak et al. | 165/136 |
| 3,173,195 | 3/1965 | Lemelson | 165/170 |
| 3,308,635 | 3/1967 | Tenniswood et al. | 62/458 |
| 3,442,094 | 5/1969 | Rush et al. | 165/136 |
| 3,912,005 | 10/1975 | Griffiths | 165/136 |
| 4,024,620 | 5/1977 | Torcomian | 165/136 X |
| 4,159,017 | 6/1979 | Novi | 165/171 X |
| 4,172,444 | 10/1979 | Atkinson | 165/168 X |

OTHER PUBLICATIONS

Colplate. Snopan. Steempan., Dean Food Service Specialty Line, Bulletin FS-73, Dean Products, Inc., Brooklyn, N.Y. dated 1979.

*Primary Examiner*—Sheldon J. Richter

*Attorney, Agent, or Firm*—Senniger, Powers, Leavitt and Roedel

[57] ABSTRACT

A refrigerated shelf for a food display counter comprising a sheet of metal having an upper surface for supporting chilled food items and a cooling coil at the underside of the shelf, the coil being adapted for the flow of coolant therethrough for cooling the shelf. Heat transfer means in heat-exchange relation with the coil and the underside of the shelf is provided for effecting a substantially uniform temperature condition throughout the upper surface of the shelf.

15 Claims, 4 Drawing Figures

REFRIGERATED SHELF FOR A FOOD DISPLAY COUNTER

BACKGROUND OF THE INVENTION

This invention relates to a shelf for a food display counter, and more particularly to a refrigerated shelf for supporting chilled food items.

The invention involves an improvement upon the refrigerated shelf of the type comprising a flat sheet of metal having an upper surface for supporting chilled food items and a corrugated sheet of metal secured to the underside of the flat sheet thereby forming a plurality of passages for flow of refrigerant therethrough for cooling the upper sheet of metal. A problem with the prior shelf has been that the temperature of the upper surface of the shelf is not uniform throughout the upper surface. In most cases, the upper sheet of metal is of stainless steel, and stainless steel is not a good heat conductor compared to other metals, so that the portions of the upper sheet of metal defining the passages are cooled to a lower temperature than are those portions of the upper sheet of metal away from the passages. The temperature differentials cause ice to form on the upper surface which can cause the chilled food items to "stick" to the shelf. The temperature differentials also prevent the formation of a uniform layer of frost over the upper surface such as is desirable to give the shelf an esthetically pleasing "frosty cold" appearance.

Another problem with the prior refrigerated shelf is that it is not well suited for above-level service (i.e., above the level of the counter top of the food display counter), because it lacks depending side walls refrigerated to substantially the same temperature as the upper surface, and a bottom surface insulated from the passages carrying the refrigerant for preventing the formation of condensation at the underside of the shelf.

SUMMARY OF THE INVENTION

Among the several objects of this invention may be noted the provision of a refrigerated shelf which provides a substantially uniform temperature condition throughout its upper surface; the provision of such a shelf which prevents the formation of ice which could cause chilled food items to "stick" to the upper surface of the shelf; the provision of such a shelf which provides an esthetically pleasing "frosty cold" appearance; the provision of such a shelf which is especially adapted for above-level service; the provision of such a shelf which has side walls extending down from the upper surface maintained at substantially the same temperature as the upper surface; the provision of such a shelf which has a bottom plate insulated from the upper surface and side walls to prevent the undesirable formation of condensation at the underside of the shelf; and the provision of such a shelf which is of relatively simple, economical construction.

Briefly, a refrigerated shelf of this invention comprises a sheet of metal having an upper surface for supporting chilled food items, and a cooling coil at the underside of the shelf, the coil being adapted for the flow of coolant therethrough for cooling the shelf. Heat transfer means in heat-exchange relation with the coil and the underside of the shelf is provided for effecting a substantially uniform temperature condition throughout the upper surface of the shelf.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
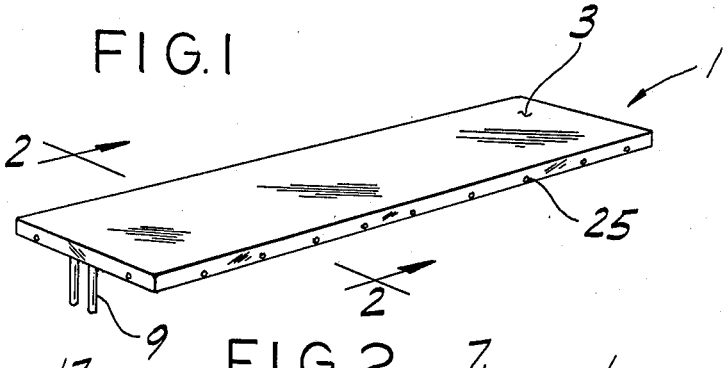
FIG. 1 is a perspective view of a refrigerated shelf of this invention.
Figure 2:
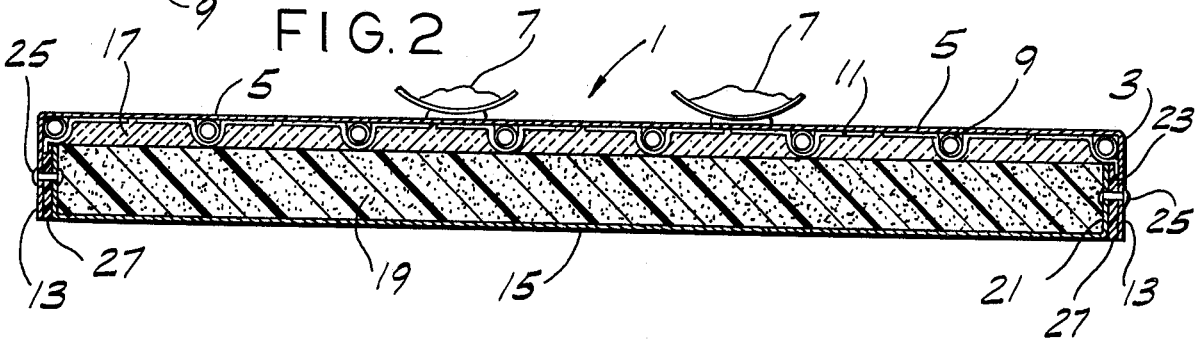
FIG. 2 is a transverse section of the refrigerated shelf on line 2—2 of FIG. 1.
Figure 3:
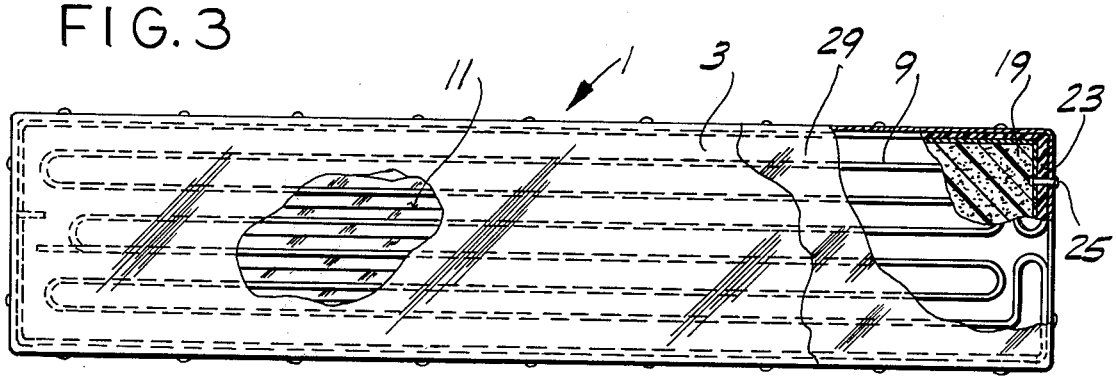
FIG. 3 is a top plan view of the refrigerated shelf with portions of the upper surface broken away.

Referring to FIGS. 1–3, there is generally indicated at 1 a refrigerated shelf of this invention for a food display counter (not shown), the shelf comprising a sheet of metal 3 having an upper surface 5 for supporting chilled food items generally indicated at 7 in FIG. 2, and a cooling coil 9 at the underside of the sheet 3, the coil being adapted for the flow of coolant therethrough for cooling the upper surface of the shelf. Heat transfer means 11 in heat-exchange relation with the coil 9 and the underside of the sheet 3 is provided for effecting a substantially uniform temperature condition throughout the upper surface of the shelf. The shelf further comprises side walls 13 extending down from the upper surface 5, first and second layers of insulation (17 and 19, respectively) covering the heat transfer means, and a bottom plate 15 covering the second layer of insulation secured to the side walls 13 of the shelf in sealed relation thereto.

Preferably, the sheet 3 of metal is of stainless steel (e.g., 14 gauge stainless steel sheet). Stainless steel is widely used for refrigerated shelves for food display counters, being highly resistant to corrosion, in particular, during long term exposure to moisture, being relatively easy to fabricate, being compatible with other components of the food display counter, and presenting an esthetically pleasing appearance which is important for the service of food. Stainless steel, however, is a relatively poor heat conductor, and heat transfer means 11 is provided to effect a substantially uniform temperature condition throughout the upper surface of the shelf. Typically, the shelf is at least several feet long and one to two feet wide.

The coil 9 comprises copper tubing arranged in a double pass pattern with a length of the tubing extending along each upper corner of the shelf as shown in FIG. 3. Adjacent lengths of tubing extend in generally parallel relation and are spaced apart several inches.

The heat transfer means 11 comprises a metal foil tape such as the aluminum foil tape sold by 3M Company of St. Paul, Minn. The foil tape comprises a layer of adhesive such as acrylic adhesive at one side thereof, and is of such width as to cover the tubing and the adjacent portions of the underside of the sheet 3. The aluminum foil tape is adhered to the coil 9 and underside of the sheet 3 by the layer of adhesive and supports the coil 9 beneath the sheet 3. A substantial portion of the area of the underside of the stainless steel sheet 3 and side walls 13 is covered by the tape so that a uniform temperature condition is effected throughout the upper surface of the sheet 3 and the side walls 13.

The first and second layers of insulation 17, 19 cover the aluminum foil tape for restricting heat transfer to the coil from below. The first layer 17 comprises a fiberglass insulation material, and the second layer 19 comprises a foamed polyurethane insulation material.

The bottom plate 15 preferably comprises a sheet of stainless steel (e.g., 18 gauge steel) and has vertically extending flanges 21 at the edges thereof. The plate 15 is insulated from the coil 9 by the insulation 17, 19 and from the side walls 13 by a thermal break 23, so that the temperature of the bottom plate is maintained at or near the ambient air temperature to prevent condensate from forming on the bottom plate. The formation of condensate is particularly undesirable when the shelf is to be used for above-level service because the condensate could drop onto food items on the shelf or surface below. The thermal break 23 comprises a preformed elongate block of high-density polyurethane material extending between the flanges 21 of the bottom plate and the side walls 13. The bottom plate is secured to the side walls 13 by conventional fastening means such as rivets 25 extending through the side walls 13, the thermal break 23 and the flange 21. A strip 27 of a suitable sealant material such as that sold under the trademark RTV silicone rubber sealant by the Silicone Products Department, General Electric Company, Waterford, N.Y. extends between the edges of the bottom plate 15 and the lower edge margins of the side walls 13 of the shelf and covers the lower end of thermal break 23 to prevent entry of moisture into the interior of the shelf 1.

In use, the refrigerated shelf 1 of this invention is mounted in a food display counter as a part of the upper surface of the counter, or is supported above the level of the counter. A suitable coolant such as a refrigerant is pumped from a refrigeration unit (not shown) through the coil 9 to cool the upper surface 5 and side walls 13 of the shelf. The aluminum foil tape transfers heat from the upper surface and side walls of the shelf to effect a substantially uniform temperature condition throughout the upper surface and side walls. A uniform layer of frost forms over time on the shelf thereby giving the shelf an esthetically pleasing "frosty cold" appearance, the thickness of the frost and the time required for it to form being a function of the temperature of the shelf and the temperature and humidity of the surrounding air. To give the shelf a "frosty cold" appearance even when insufficient frost has formed, the upper surface and side walls preferably have a layer of white baked enamel paint 29 thereon, as shown in FIG. 3.

Figure 4:
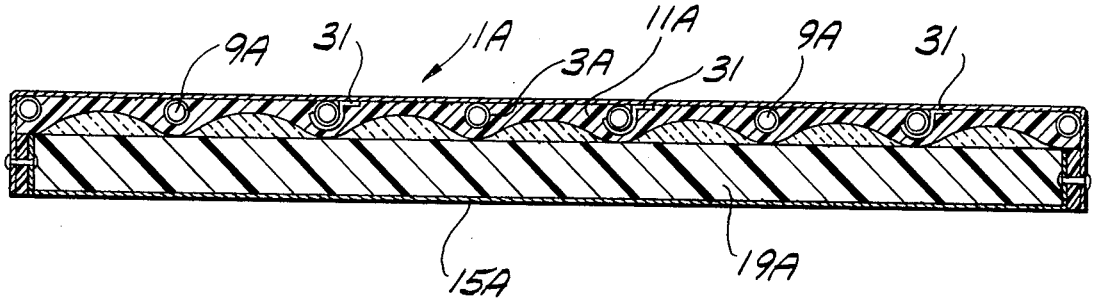
FIG. 4 is a transverse section of an alternative embodiment of the refrigerated shelf.

An alternative embodiment of the refrigerated shelf 1A shown in FIG. 4 is similar to the above-described refrigerated shelf 1 except that the heat transfer means 11A comprises a suitable moldable adhesive material having good heat transfer properties such as that sold under the designation Presstite No. 440.22 Thermal Mastic Compound by Presstite Products, St. Louis, Mo. Fasteners such as stainless steel clips 31 support the coil 9A in engagement with the underside of the sheet 3A. The adhesive material is applied on the coil 9A and the underside of the sheet 3A.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A refrigerated shelf for a food display counter comprising:

an upper member having an upper surface for supporting chilled food items and flanges extending down from the upper surface constituting side walls of the shelf;

a cooling coil at the underside of the upper member, the coil being adapted for the flow of coolant therethrough for cooling the shelf;

heat transfer means in heat-exchange relation with the coil and the underside of the upper member for effecting a substantially uniform temperature condition throughout the upper surface of the shelf, and with the coil and the side walls of the shelf for cooling the side walls;

insulation covering the heat transfer means and the coil;

a lower member secured to the side walls of the shelf covering the insulation, the lower member being contained within the upper member so that the lower member is at least at the level of the lower edges of the side walls, and having a perimeter spaced inwardly from the side walls; and a thermal break extending along the perimeter of the lower member in the space between the lower member and the side walls of the shelf to enable the lower member to be maintained at a temperature above that of the upper surface and side walls of the shelf.

2. A refrigerated shelf as set forth in claim 1 wherein the heat transfer means covers the underside of the coil and at least a portion of the underside of the upper member.

3. A refrigerated shelf as set forth in claim 2 wherein the heat transfer means comprises a foil tape having a layer of pressure-sensitive adhesive thereon, the coil being supported beneath the upper member by the tape.

4. A refrigerated shelf as set forth in claim 3 wherein the foil tape is an aluminum foil tape.

5. A refrigerated shelf as set forth in claim 2 wherein the heat transfer means is a moldable adhesive material.

6. A refrigerated shelf as set forth in claim 1 wherein the upper member is of stainless steel sheet.

7. A refrigerated shelf as set forth in claim 1 wherein the coil comprises copper tubing.

8. A refrigerated shelf as set forth in claim 1 wherein the insulation comprises a layer of fiberglass and a layer of foamed polyurethane.

9. A refrigerated shelf as set forth in claim 1 having a layer of baked enamel on the upper surface and the outer surface of the side walls of the shelf.

10. A refrigerated shelf as set forth in claim 1 wherein the bottom of the lower member is generally at the same level as the lower edges of the side walls.

11. A refrigerated shelf as set forth in claim 1 further comprising means for securing the lower member to the side walls comprising a plurality of fasteners each extending laterally inwardly from one of said side walls through an opening in the thermal break to the lower member.

12. A refrigerated shelf as set forth in claim 11 wherein the securing means further comprises means on the lower member projecting upwardly toward but stopping short of the coil, said means having holes therein adapted to receive said fasteners.

13. A refrigerated shelf as set forth in claim 1 wherein the lower edge of the thermal break is above the lower edge of the side walls and the bottom of the lower member, and wherein the shelf further comprises sealant material between the side walls and the lower member covering the lower edge of the thermal break.

14. A refrigerated shelf for a food display counter comprising:

an upper member having an upper surface for supporting chilled food items and flanges extending down from the upper surface constituting side walls of the shelf;

a cooling coil at the underside of the upper member, the coil being adapted for the flow of coolant therethrough for cooling the shelf;

heat transfer means in heat-exchange relation with the coil and the underside of the upper member for effecting a substantially uniform temperature condition throughout the upper surface of the shelf, and with the coil and the side walls of the shelf for cooling the side walls;

insulation covering the heat transfer means and the coil;

a a lower member secured to the side walls of the shelf covering the insulation; and a thermal break between the lower member and the side walls of the shelf to enable the lower member to be maintained at a temperature above that of the coolant in the coil, the lower member having upwardly extending flanges spaced inwardly from the side walls of the shelf, the thermal break extending between the flanges of the lower member and the side walls of the shelf.

15. A refrigerated shelf as set forth in claim 14 further comprising sealant material covering the lower edge of the thermal break.

* * * * *